US006045278A

United States Patent [19]

Kubatzki et al.

[11] Patent Number: 6,045,278

[45] Date of Patent: Apr. 4, 2000

[54] APPARATUS FOR TRANSPORTING AND PRINTING PRINT MEDIA

[75] Inventors: Ralf Kubatzki; Stephan Guenther, both of Berlin, Germany

[73] Assignee: Francotyp-Postalia AG & Co., Birkenwerder, Germany

[21] Appl. No.: 09/146,359

[22] Filed: Sep. 3, 1998

[30] Foreign Application Priority Data

Sep. 5, 1997 [DE] Germany ..... 197 40 395

[51] Int. Cl.[7] ..... B41J 13/08

[52] U.S. Cl. ..... 400/635; 347/4; 271/7; 101/93

[58] Field of Search ..... 400/635, 636, 400/708; 101/93; 271/2, 7, 11, 3.22, 3.33; 347/4, 104

[56] References Cited

U.S. PATENT DOCUMENTS

| | | | |
|---|---|---|---|
| 3,504,909 | 4/1970 | Burkhardt | 271/11 |
| 3,877,531 | 4/1975 | Storace et al. | 177/1 |
| 4,004,507 | 1/1977 | Sautton | 101/93.42 |
| 4,903,954 | 2/1990 | Robertson et al. | 271/7 |
| 5,025,386 | 6/1991 | Pusic | 364/478 |
| 5,197,812 | 3/1993 | Worley et al. | 400/635 |
| 5,291,002 | 3/1994 | Agnew et al. | 235/375 |
| 5,467,709 | 11/1995 | Salomon | 101/93 |
| 5,757,407 | 5/1998 | Rezanka | 347/102 |
| 5,880,747 | 3/1999 | Bartenwerfer et al. | 347/4 |
| 5,883,643 | 3/1999 | Mok et al. | 347/4 |

FOREIGN PATENT DOCUMENTS

| | | |
|---|---|---|
| 25 33 232 | 2/1977 | Germany . |
| 195 08 180 | 9/1996 | Germany . |
| 196 05 014 | 3/1997 | Germany . |
| 196 05 515 | 3/1997 | Germany . |
| 2 272 401 | 5/1994 | United Kingdom . |
| WO 85/01915 | 5/1985 | WIPO . |

OTHER PUBLICATIONS

Estabrooks, IBM Technical Disclosure Bulletin, "Vacuum Belt Transporter," vol. 23, No. 6, Nov. 1980.

*Primary Examiner*—Christopher A. Bennett
*Attorney, Agent, or Firm*—Hill & Simpson

[57] ABSTRACT

An apparatus for transporting and for printing print media has an inclined guide plate and a transport mechanism orthogonal to this guide plate and an auxiliary device. An ink jet print head controlled by a control unit is rigidly arranged in a recess of the guide plate during printing. The recess is fashioned such that the print medium has a printed region lying free downstream. The print medium transported with the transport mechanism lies without any mechanical clamping against the auxiliary device, that has an ascending guide and allows a defined slippage perpendicular to the transport mechanism surface. Independently of the slope of the floor area of the machine, a non-contacting printing with the ink print head ensues with high print quality for print media transported standing or lying. A placement device precedes the guide plate for the adaptation of the inclination angle α.

21 Claims, 5 Drawing Sheets

APPARATUS FOR TRANSPORTING AND PRINTING PRINT MEDIA

BACKGROUND OF THE INVENTION

1. Field of the Invention

The present invention is directed to an apparatus for transporting and for printing print media, particularly letters in postage meter machines.

2. Description of the Prior Art

In machines of the above type, the print media are conducted along a printer device and the franking and possibly further information are printed in one pass.

It is standard to conduct the print medium along the printer device either lying flat, see, for example, as in U.S. Pat. No. 5,467,709, or standing on an edge, see, for example, German OS 25 24 670 and U.S. Pat. No. 5,025,386.

In any case, it is important that the print medium and the printer device reach a defined position relative to one another so that the imprint ensues at the intended location and with adequate quality.

Given horizontal transport, a relatively large seating surface is required in conformity with the largest print medium format which may be used, resulting in a large floor area is being required machine. In the solution according to U.S. Pat. No. 5,467,709, printing is carried out in non-contacting fashion with the ink print head. The letter is conveyed clamped between a driven conveyor belt and resiliently seated pressure rollers, whereby the letter also lies against a longitudinal guide plate. The longitudinal guide plate is provided with a recess matched to the conveyor belt and with a rectangular recess for the ink print head, the nozzle rows of the ink print head proceeding diagonally across the print head. The conveyor belt, the longitudinal guide plate and the ink print head are arranged above the letter. The resilient pressure rollers and a pressure roller resiliently seated in the printing region are arranged under the letter. The spring-caused movement extent of the pressure rollers and of the pressure plate corresponds to the maximum thickness of the letters, which can fluctuate between 0.2 mm and 20 mm. The spring power must be adequate for the entire weight range of the letters—approximately 20 through 1000 g—and must also be adequate for the letters to lie in planar fashion in the region of the recess for the print head. A constant, optimally slight distance between print medium and ink print head must be adhered to for the non-contacting ink print process so that splatters have little influence and so that the print medium does not touch the nozzle surface and smears are thus avoided. The risk of smearing still exists, however, when the letter leaves the region of the recess and then glides in a constrained manner along the longitudinal guide plate. These conditions are difficult to achieve to given rapidly changing mixed mail.

A system for processing outgoing letter mail differing in weight and differing in dimensions is known from German PS 25 24 670, wherein the letters are conveyed on edge with a conveyor path. The conveyor path has driven roller pairs and a conveyor belt. In the region preceding the franking imprint, the letter is stopped by the conveyor belt by a friction belt and is transported by a guide rollers to a postage drum or printing drum with a counter-pressure drum. The counter-pressure drum is seated on a moveable pressure base whose distance from the printing drum is adjustable corresponding to the thickness of the letter currently passing through the franking station.

Aside from the fact that printing drums will no longer meet stricter postal authority demands in future, the pressure base contains a considerable number of moving component parts. This requires a correspondingly large energy outlay for overcoming the mass moment of inertia.

Further, a postage meter machine is known from U.S. Pat. No. 5,025,386, wherein the letters are conveyed upright, slightly inclined on a circulating conveyor belt. The letters thereby lie against a guide block in which a print window is provided. A thermal printing head is arranged so as to be height-displaceable and laterally displaceable in the print window, which produces a franking print on the letter. The size of the print window must be matched to the maximum length and width of the print format. The individual letter is moved up to the print window and is then arrested and pressed against the guide plate or the print window with a pressure plate. The pressure plate is driven by a motor via a tooth gearing and crank articulation. This is a comparatively great mechanical outlay and the counter-pressure forces exerted for the thermal printing are likewise large.

After printing, the letter is released and further-conveyed. Clearly, only slight letter throughput quotas can be achieved with this intermittent operation. The outlay for the adjustment of the thermal print head is substantial.

For simplifying the letter transport and for improving the printing technology, German PS 196 05 014 discloses an apparatus for printing a print medium standing on edge that allows a contact-free printing with an ink print head. Compared to the floor area of the franking and/or addressing machine, a guide plate inclined slightly relative to 90° with a recess for an ink print head and a circularly running conveyor belt orthogonal to the guide plate are employed on which the print medium, particularly letters or other mailings, reside lying tilted against the guide plate, the guide plate being inclined 18° out of the perpendicular. Due to the utilization of the continuous transport and of the ink print head, a continuous printing process is possible. Since printing is carried out in a non-contacting manner, the placement force is adequate for a defined attitude of the mail relative to the print head due to the inclination of the guide plate and of the conveyor belt. The friction at the guide plate can be kept low with a correspondingly smooth surface and/or slide rails. The recess which is open in the transport direction prevents a smearing of the print format and lengthens the drying time for the printed dots. If the drying time of the ink is extremely short, it is proposed to provide a correspondingly long, closed recess. If smearing of the print format occurs in the deposit of pieces of mail, this is due to the excessively high transport speed or due to lack of smear-resistance of the ink; at any rate, a drying time for the printed pixels of applied ink droplets that limits the transport speed should be optimally short. This is possible to only a limited degree on the basis of a correspondingly selected ink. Given pieces of mail that have an unstable or uneven contact, it is difficult to constantly adhere to a defined distance of the print medium surface from the nozzles of the ink jet print head.

Moreover, given a pronounced inclination of the guide plate relative to the perpendicular on the reference plane, a differential speed between a thick envelope, particularly a franking tape or a similar print medium, and the conveyor belt can arise when the friction of the envelope or print medium surface at the guide plate and/or the slide rails cannot be kept low enough compared to the friction of the envelope or print medium edge at the conveyor belt. It is obvious that such an apparatus is better suited for thick envelopes or packages or mailings having a higher inherent weight than for thin envelopes or light weight pieces of mail. This solution is unsuitable for printing address or franking tapes.

For improving the letter transport, German PS 196 05 015 discloses an apparatus for printing the print medium standing on edge that allows a non-contacting printing with an ink print head on thin print media. Specific pressure elements moveable toward and away from the guide plate are arranged on the conveyor belt as means for applying a thrust force to the print medium along the guide plate. The franking system Jet Mail® developed by the assignee on the basis of the aforementioned German Patent still allows the transport of up to 5,500 letters per hour with a thickness up to 20 mm and is thus the fastest franking system with ink jet printer technology. This solution also guarantees slip-free transport of franking tapes and even processes mixed mail. Due to the utilization of pressure elements on the conveyor belt surface, however, the latter, differing from the solution according to German PS 196 05 014, cannot be utilized in full width. This, of course, leads to irritating delays when the franking system is stopped given excessively thick letters in order to print a franking tape and then to glue this on by hand. It would therefore be desirable if even thicker letters could be automatically transported and franked.

The pressure elements also project so far from the conveyor belt surface that a position relative to the recess for the ink print head is reached. For the application of the franking imprint, a first nozzle of the ink print head must already print at a spacing of 10 mm from the placement edge at the conveyor belt surface. At least one pressure element and at least a number of nozzles thus exist for which a clamping of the piece of mail or print medium, for example a franking tape, is effective. This clamping can only be conditionally applied given specific, thin pieces of mail when, for example, the letter contains paper clips or other irregularities in this region or when an unstable envelope content does not guarantee a dimensional stability of the piece of mail. In such instances, the distance of the print medium surface from the nozzle plane of the ink print head cannot be kept constant, this contributing to a degradation of the print quality.

SUMMARY OF THE INVENTION

An object of the present invention is to create an apparatus for fast transport and printing of a print medium standing on edge that allows a non-contacting printing with an ink jet print head for extremely thin and thick pieces of mail and thereby avoids the disadvantages of the prior art. The print quality of the imprint printed with ink jet printing technology should also be improved for all types of mailings regardless of whether they have an irregular or unstable content. A further object is to reliably transmit a high speed in transport direction onto the print medium and to minimize the drying time of the ink after printing. In one version, an inclination in arbitrary direction relative to the reference plane should be allowed for the machine floor area given unaltered print quality.

This object is inventively achieved in an apparatus for transporting and for printing print media having an inclined (non-horizontal) guide plate and a transport arrangement orthogonal to this guide plate as well as an auxiliary device. An ink jet print head controlled by a controller is permanently arranged in a recess of the guide plate during printing. The recess is fashioned such that the print medium lies free downstream with the printed region, i.e. does not lie against the guide plate.

The print medium stands on edge on the conveyor means lies flat on the conveyor means on its lateral surface, so that its surface to be printed lies against a guide. The apparatus for printing such a standing or lying print medium has a vertical guide plate or a guide plate inclined relative to the vertical, whereby the inclination can be positive or negative relative to the vertical to the reference plane. The reference plane is a planar, horizontal floor area of the machine, for example, on a table top. The aforementioned vertical reference is also referred to below as perpendicular to the reference plane.

The best printing quality is achieved when the surface to be printed lies flat and regardless of the attitude relative to the reference plane with which the print medium is transported during printing. It is also assumed that a suitable type of application of the print medium against the guide is important and that a clamping in the print region must be avoided. An auxiliary device having a guide without clamping is thus utilized for biasing the print medium surface.

This auxiliary device, in a first version, includes a first transport and guide arrangement and is effective under the influence of the force of gravity at a guide plate positively inclined to the reference plane relative to the vertical. The print medium stands on a transport arrangement and simultaneously lies against the auxiliary device, which has an ascending guide and allows a defined slippage perpendicular onto the transport arrangement surface. The conveyor, in collaboration with the transport and guide arrangement, allows a high speed in the transport direction to be transmitted slip-free to the print medium.

In the first version of the transport and guide arrangement, the guide elements of the guide plate have a slope and the side plate is equipped with a transport arrangement exerting a suction. This enlarges the spacing of the parts of the print medium surface lying at a distance from the region to be printed from those parts of the print medium surface lying close to the seating edge of the print medium on the surface of the transport arrangement in order to achieve the desired tautening of the print medium under the influence of the force of gravity.

For tautening the print medium surface, a second version of the auxiliary device is utilized, the auxiliary device being arranged at a vertical plate or at a guide plate negatively inclined relative to the vertical to the reference plane in order to achieve a clamp-free guidance. Such an auxiliary device includes two transport and guide arrangement. The advantage compared to the first version is that tautening is achieved with the same effect given extremely light weight print media, particularly thin letters, as given thicker print media or letters.

Inventively, the tautening of the print medium surface to be printed is achieved by the aforementioned transport and guide arrangement of the auxiliary device that exerts a suction on parts of the print medium surface at both sides of the region to be printed, whereby a first transport and guide arrangement exerts a suction on parts of the print medium surface lying at a distance from the region to be printed, and is equipped with a guide ascending in the transport direction, as well as a further transport and guide arrangement which exerts a suction on parts of the print medium surface close to the seating edge of the print medium on the transport arrangement surface and parallel to the transport direction.

A further advantage of the inventive auxiliary device according to the second version is that the floor area of the machine need not be planar. The transport and guide arrangements assure a seating against the guide plate or the slide rails thereof even under more difficult conditions. The floor area, compared to the first version, therefore need not lie without inclination relative to the reference surface; a sloped placement is tolerable.

DESCRIPTION OF THE PREFERRED EMBODIMENTS

Figure 1A:
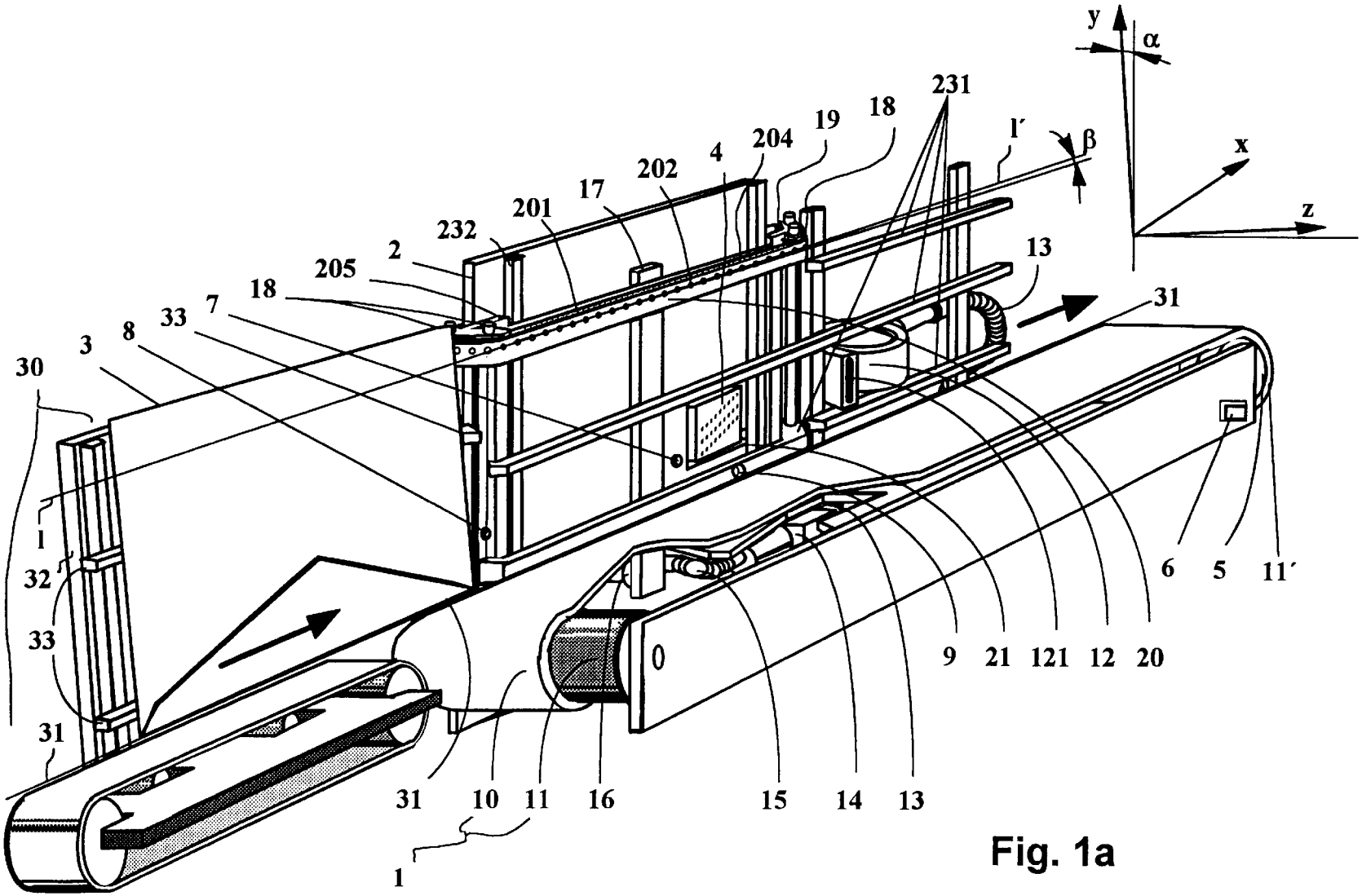
FIG. 1*a* is a perspective view of a first version of an inventive apparatus having an auxiliary device at a guide plate positively inclined relative to the vertical to the reference plane with a guidance without clamping.

FIG. 1*a* shows a perspective view of the first version of an inventive apparatus having an auxiliary device at a guide plate positively inclined relative to the vertical to the reference plane, which has a clamp-free guidance. A first transport mechanism 1 is formed by a conveyor belt 10 and two drums 11, 11'. The drums 11' is the drive drum. Both drums 11, 11' are preferably toothed drums and the conveyor belt 10 is a toothed belt. On positive force transmission is thus assured. The drive drum 11' together and an incremental sensor 5 are rigidly seated on a common shaft and produces a signal corresponding to movement along the transport path. The incremental sensor 5 is for example, a slotted disk that interacts with a reflected light barrier 6 (light-emitting diode/photo cell), as disclosed in German PS 196 05 014.

In a Cartesian coordinate system, the transport direction and the longitudinal edge of the conveyor belt 10 proceed in the x-direction. The z-direction proceeds across the width of the conveyor belt 10 and the y-direction is orthogonal thereto, i.e. in the direction of the height of the guide plate 2. The conveyor belt 10 lies in the xz-plane at the angle $\alpha$ relative to the reference plane. The guide plate 2 lies in the xy-plane and describes an angle of 90° with the conveyor belt 10.

Given a positive slope, the inclination of the guide plate is greater than 90° relative to the reference plane and the print medium 3 already has a secure seated position against a guide structure, preferably formed by slide rails 231, of the guide plate 2 due to the force of gravity, as described in German PS 196 05 014. In addition to being transmitted by the first transport mechanism 1, the transfer of the transport speed to the print medium 3 in the first version also ensues on the basis of the inventive, specific fashioning of the auxiliary device 20 as a transport and guide arrangement of the guide plate 2 generating a suction. The slanted attitude is preferably at an angle $\alpha<18°$ of the zx-plane from the perpendicular. Due to the smaller angle $\alpha$, reduced friction between the guide structure (slide rails 231); of the guide plate 2 and the print medium 3 is already achieved. The transport mechanism 1 is simply formed by the conveyor belt 10. Alternatively, an arrangement composed of a number of rollers or the like can be employed. The print medium 3, for example, a letter that is to be franked. A high clock rate and a printing in a single path are particularly important for achieving high piece numbers of print media.

A guide plate 2 is orthogonally arranged relative to the conveyor belt 10, for example positively inclined at an angle $\alpha=10°$ relative to the perpendicular. The letters 3 standing on the conveyor belt 10 have their surface 300 to be printed lying against the guide plate 2. Given movement of the conveyor belt 10, the letters 3 slide along the stationary guide plate 2. For improving the glide properties, the guide plate 2 is provided with slide rails 231 parallel to the transport direction. Downstream, the guide plate 2 has at least one recess 21. The recess 21 is arranged at the level of the franking imprint to be applied. An ink jet print head 4 has a nozzle surface arranged parallel to the guide plate 2 in the recess 21 such that the distance from the passing letter amounts to approximately 1–2 mm. An arrangement for accelerating ink drying, for example a motor suction pump 12 with a blower 121, is arranged farther downstream. An air stream is thus blown over each letter 3 at the level of the region to be printed and the letter 3 is guided in non-contacting fashion with the slide rails 231.

A sensor 7 for recognizing the start (leading edge) of the letter is provided in the guide plate 2 shortly before the recess 21. In collaboration with the incremental sensor 5, a print signal is triggered by the sensor 7. The ink jet print head 4 is driven by a control unit 40 and is connected to an ink reservoir via an ink delivery system (not shown).

During printing, the ink jet print head 4 arranged in the recess maintains a fixed position from which the ink jet print head 4 can be swiveled in the printing pauses, or after the conclusion of all printing events, into a position adjacent to a cleaning and sealing station (not shown), No. DE-P.S 197 26 642.8 (U.S. Ser. No. 09/099,473).

A line I–I' having the slope h at the end of the auxiliary device in the transport direction exists on the conveyor belt surface of the first transport arrangement relative to an imaginary parallel line at a distance from the placement edge 31 of the print medium 3. The guidance of the transport and guide arrangement 20 generating a suction is oriented relative to this line I–I' in order to increase the distance of those parts of the print medium surface lying at a distance from the region to be printed from those parts of the print medium surface 300 lying close to the placement edge 31 of the print medium 3 at the conveyor belt surface. This achieves a tautening of the letter 3 under the influence of the force of gravity. The line I–I' describes an angle $\beta$ of less than equal to 20° with a parallel spaced from the placement edge 31.

Figure 2A:
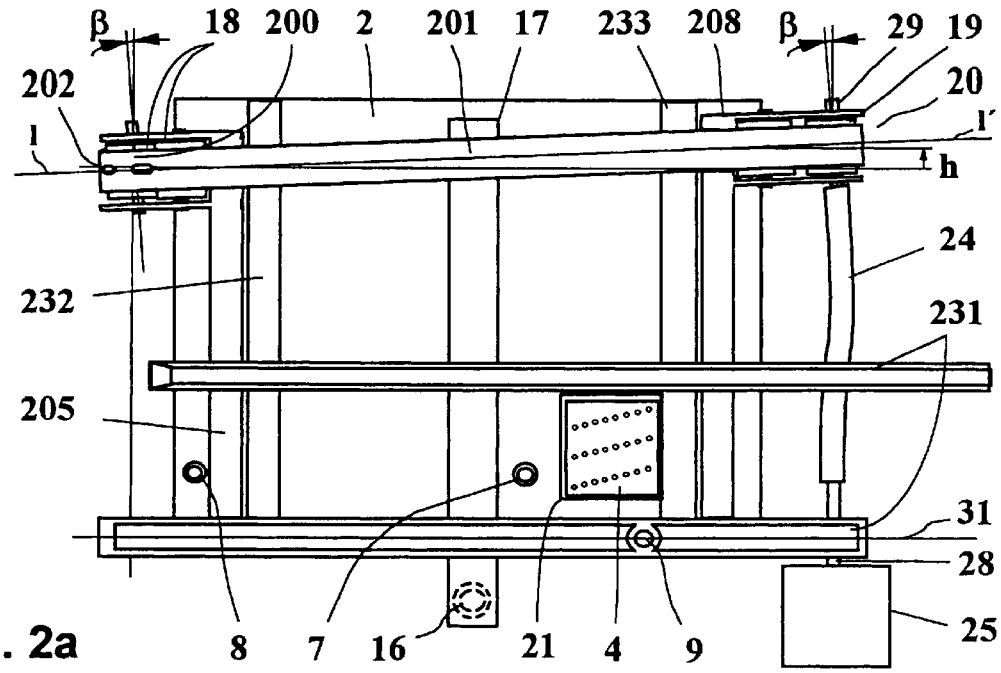
FIG. 2*a* is a view of the inventive auxiliary device at the guide plate according to the first version of the invention.

FIG. 2*a* shows a view of the inventive auxiliary device at the guide plate 2 for tautening the print medium surface and for guiding without clamping in conformity with the first version. The inventive auxiliary device is a conveyor belt 201 guided at the angle $\beta$ with guide elements 204 through 206. Retainer rails 205, 208 of the auxiliary device lie against the respective seating rails 232, 233 of the guide plate 2 at both sides, preceding and following the recess 21 in the guide plate 2 for the ink jet print head 4, i.e. at both sides relative to the printing region.

For guiding the print medium 3, the transport and guide arrangement 20 of the inventive auxiliary device is held in position orthogonally relative to the seating rails 232, 233 by the aforementioned seating rails 232, 233 of the guide plate 2 and is held at a defined distance from the placement edge 31 by being fastened at retaining rails 205, 208. The fastening of the guide elements 204, 206 ensues at the retainer rail 205 at a defined distance preceding the recess 21. The fastening of the guide elements 204, 206 ensues following the recess 21 in the guide plate 2 at the retainer rail 208 at a distance which is longer by the path length h than the distance of the fastening to the retainer rail 205 preceding the recess 21 in the guide plate 2. A rise h is thus achieved in the guidance of the print medium 3 in the transport direction along the line I–I' between the two retainer rails 205 and 208. For exerting a suction, the transport and guide arrangement 201 through 204, 206 is connected to a suction manifold 17.

Figure 3A:
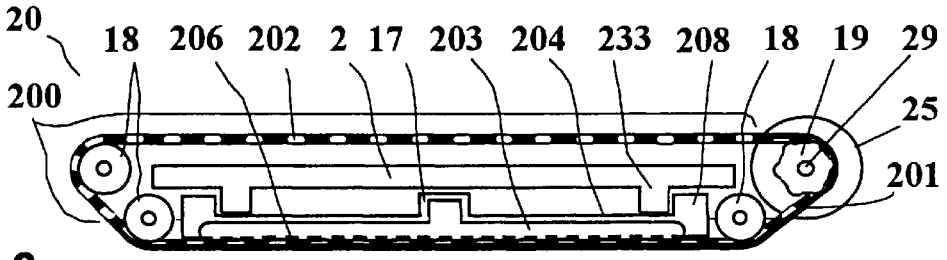
FIG. 3*a* is a section along the line I–I' through an auxiliary device at the guide plate in the first version of the invention.

The conveyor belt 201 shown in FIG. 3*a* runs over guide rollers 18 and a drive roller 19 of the transport and guide arrangement 20 of the auxiliary device with the same transport speed as the conveyor belt 10 shown in FIG. 1*a* as soon as a print medium 3 is detected with the sensor 8. The two drives, i.e. the drive of the transport mechanism 1 and the drive 25 of the auxiliary device, are preferably coupled to one another. The drive 25 of the drive roller 19 in the auxiliary device thereby operates synchronously with the drive of the drive drum 11'. For example, one of the drives is fashioned as a gear train which is coupled from the other drive so as to be operated as soon as a print medium 3 reaches the sensor 8. To that end, the drive 25 is connected to a control unit 40 that controls a corresponding switchover or clutch.

A flexible shaft 24 preferably connects the axle 28 of the drive 25 to the axle 29 of the drive roller 19 for the conveyor belt 201. The two axles 28 and 29 thereby lie at the angle β relative to one another. The flexible shaft 24 is composed, for example, of a helical spring and a close-fitting plastic tube section. Alternatively, the shaft 24 can be fashioned as a Cardan shaft.

FIG. 3*a* shows a section through the auxiliary device along the line I–I' at the guide plate 2. The suction manifold 17 connects a suction chamber 203 in the suction housing 204 of the transport and guide arrangement 20 of the auxiliary device via a connector 16 to a pressure hose 15 (shown in FIG. 4*a*) that applies a predetermined suction p. The suction p in the suction chamber 203 of the suction housing 204 is conducted through a perforated plate 206 to the holes 202 of the conveyor belt 201. The conveyor belt 201 has a predetermined length and has the openings 202 only in the region 200, these openings 202 being capable of communicating the suction to the print medium surface 300.

As shown in FIG. 3*a*, the conveyor belt 202 closes all of the openings in the perforated plate 206 and the suction can thus be built up in the suction chamber 203. As soon as a print medium 3 is detected with the sensor 8, the control unit 40 increases the suction and places the conveyor belt 201 into a transport motion along the guide along the line I–I'. The length of the conveyor belt 201 corresponds to the sum of the print medium length shortest print medium 3 and the shortest distance between the two successively supplied print media 3. The drive 25 is correspondingly driven by the control unit 40, so that the conveyor belt 201 is again stopped after one revolution if no further print medium 3 is detected. This can be achieved by decoupling the drive 25 from the drive of the drive drum 11'.

The friction pairing between the auxiliary device and the print medium 3 (paper or similar material) exhibits optimally high values. Optimally low friction values are achieved within the transport and guide arrangement 20 of the auxiliary device between the perforated plate 206 and the conveyor belt 201. The conveyor belt 201 of the transport and guide arrangement 20 of the auxiliary device is composed of a slidable, abrasion-resistant and flexible plastic that is coated with rubber at the exterior. A high coefficient of static friction $\mu$ thus is produce, for example, given the friction pairing of paper/rubber. A suction force $F_s$ that is proportional to the product of the pressure p and the area A of an opening 202 at the conveyor belt 201 is orthogonally exerted onto the surface 300 of the print medium 3 via openings 202 in the conveyor belt 201. The following is valid for the area A of the surface 300 on which the pressure p acts:

$$F_s = p \cdot A \tag{1}$$

The force exerted by the auxiliary device applied via all openings 202 to the print medium 3 is proportional to the suction force $F_s$; the static friction FH thus:

$$F_H = \mu \cdot F_s = \mu \cdot p \cdot \Sigma A \tag{2}$$

Figure 4A:
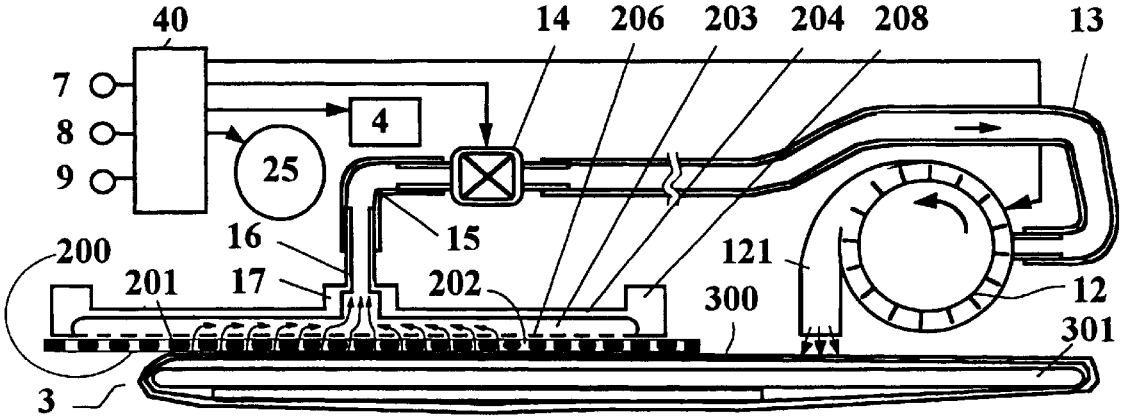
FIG. 4*a* schematically illustrates the air guidance arrangement of the auxiliary device at the guide plate and the control thereof in the first version of the invention.

FIG. 4*a* schematically shows an air guidance arrangement given a guide plate of the first version with a control unit 40. The air guidance ensues from the suction chamber 203 of the transport and guide arrangement 20 of the auxiliary device via the suction channel 17, the connector 16, the pressure hose 15 to the valve 14, the pressure hose 13 to the motorized suction pump 12 having a dryer arrangement 121 that accelerates ink drying.

The control unit 40 has an input side connected at least to the sensor 8 and an output side connected to the controllable valve 14 and to the motorized suction pump 12. The beginning of printing is calculated by the control unit 40 according to the transport speed. Given an increase in suction proceeding beyond a predetermined valve, the valve 14 draws secondary air from the environment. The size of the predetermined suction valve can be controlled by the control unit 40.

The valve 14 for secondary air is closed when the print medium 3 reaches a first sensor 8. For example, the valve 14 can be correspondingly set by the control 40 in order to achieve a maximum suction. As warranted, the capacity of a motor of the pump 12 is briefly increased. Subsequently, the suction force $F_s$ is gradually reduced step-by-step with the transport of the print medium along the line I–I' by reducing the pressure p with the controllable valve 14. The force exerted for overcoming the static friction exerted by the transport and guide arrangement 20 thus becomes smaller and smaller in the transport direction a transport proceeds, so that no lift-off of the print medium 3 ensues but the surface of the print medium is tautened.

In a further version—as shown in FIG. 1*a*—, the control unit 40 has the input side connected to the sensors 7, 8, and 9. The start of printing is calculated by the control unit 40 in conformity with the transport speed, whereby the transport of the print medium 3 that has actually ensued can be checked using signals from the sensors 7 and 8.

An additional sensor 9 is arranged at the print head at the height of the placement edge 31 of the print medium 3 on the conveyor belt surface of the first transport mechanism 1, this additional sensor 9 being interrogated by the control unit 40 in order to report a lift-off (if it occurs) of the print medium 3 from the conveyor belt surface of the first transport mechanism 1. If this occurs, action is taken to correspondingly reduce the suction force $F_s$ by reducing the suction p with the controllable valve 14.

Additionally, the control unit 40 operates a cleaning and sealing device (not shown) and further assemblies of the base station, for example of the ink jet print head 4, or further stations (not shown) of a franking system, as disclosed in detail, for example, in the German Application 197 11 997.2.

Figure 1B:
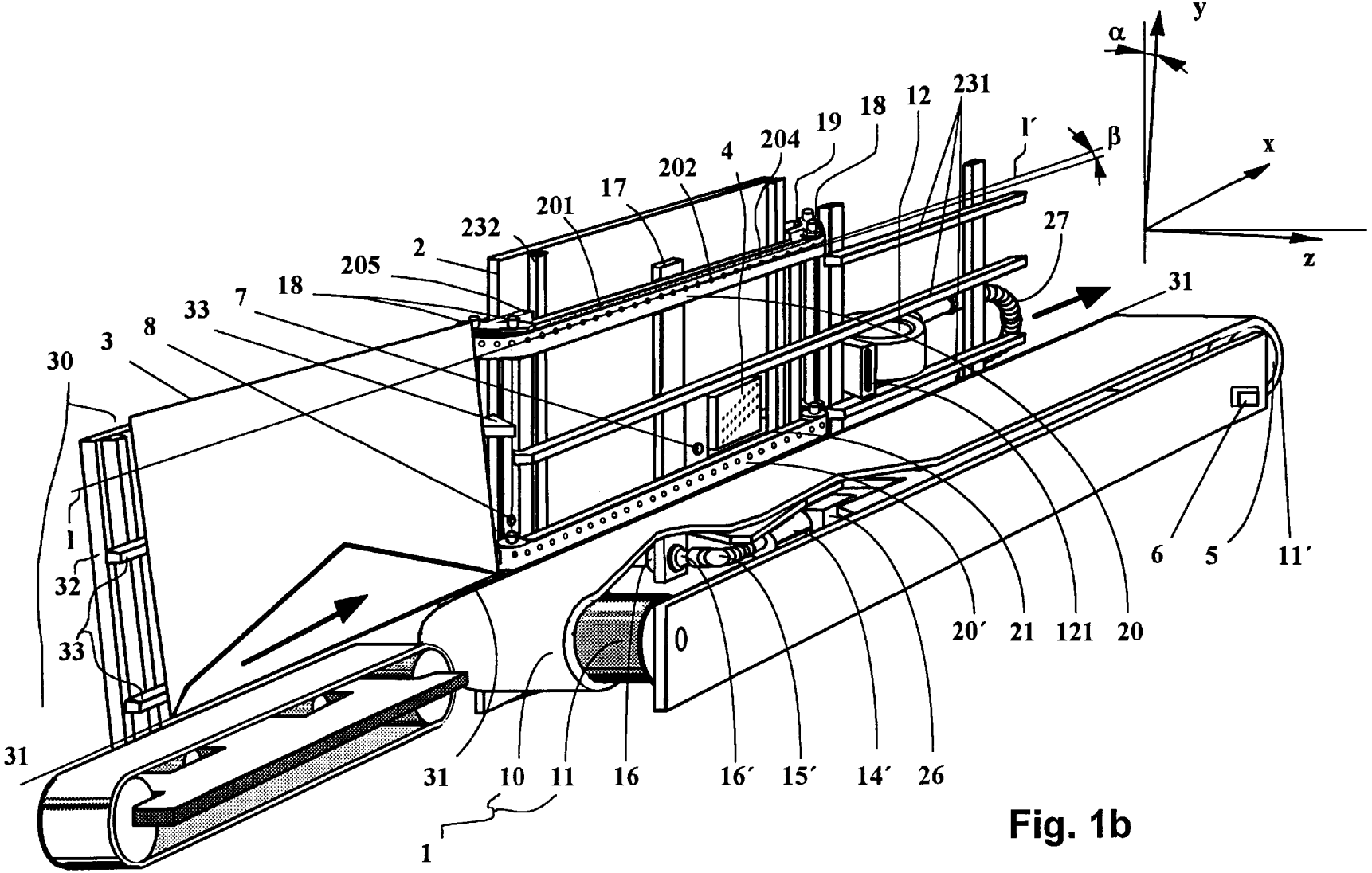
FIG. 1*b* is a perspective view of a second version of an inventive apparatus having an auxiliary device at a guide plate negatively inclined relative to the vertical to the reference plane with a guidance without clamping.

FIG. 1*b* shows a perspective view of the second version inventive apparatus, having an auxiliary device at a guide plate negatively inclined (relative to the vertical) to the reference plane that is likewise equipped with a guidance without clamping. In addition to the first transport and guide arrangement 20, a further transport and guide arrangement 20' is inventively additionally arranged at both sides relative to the ink jet print head 4 so that tautening of the print medium surface 300 to be printed ensues. Compared to the first version, the tautening is achieved without the effect of the force of gravity, so that the tautening is possible with the same effectiveness for extremely lightweight print media 3, particularly thin letters, as for thicker print media 3 or letters.

Inventively, the aforementioned transport and guide arrangements 20, 20' exert suction on parts of the print medium surface at both sides of the region to be printed. The first transport and guide arrangement 20 exerts suction on parts of the print medium 300 lying at a distance from the region to be printed and is equipped with a guide ascending in transport direction, as well as whereby the further transport and guide means 20' exerts an under-pressure onto parts of the print medium surface close to the placement edge of the print medium on the conveyor belt surface and parallel to the transport direction of the conveyor belt.

Given a negative slope, the inclination of the guide plate lies below 90° relative to the reference plane, and the printing medium 3 has a placement position on guide elements of the guide plate 2 that is maintained by suction. Inventively, the guide plate 1 in the apparatus of the second version can assume exactly 90° or a positive slope relative to the reference plane. Given the version with exactly 90°, the guide plate 2 is perpendicularly aligned. Compared to the version with positive inclination, a minimization of the friction between the print medium 3 and the other guide arrangement 23 that has no transport mechanism is already achieved. The slanting attitude is preferably at an angle of $0° \leqq \alpha \leqq 10°$ of the zx-plane from the perpendicular. This positive inclination relative to the reference plane can be caused by a slanting position of the floor area of the machine without resulting in a negative influence on the printing quality.

A negative inclination produces barely any frictional losses or wear of material. Such a slanting attitude also facilitates the turning and the deposit of the pieces of mail after printing, so that the imprint is visible after the deposit thereof when viewed. An additional preceding placement device 30 has a positive inclination relative to the guide plate 2, i.e. the inclination of a placement guide plate 32 (shown in FIG. 1*b*) lies above 90° relative to the reference plane, and the print medium 3 already has a reliable placement position against the guide means of the placement guide plate 32 as a result of the force of gravity. The placement device 30 preferably has slide rails 33 at the placement guide plate 32 that product a positive or vertical or negative inclination of the guide plate 2.

A tape dispenser means (now shown) that likewise precedes and is parallel to the placement auxiliary device 30 can apply the tape to the further transport and guide arrangement 20' which exerts suction parts of the print medium surface close to the placement edge 31 of the print medium 3 on the surface of the conveyor belt 10 and parallel to the transport direction of the conveyor belt 201. The tape dispenser means is preferably constructed as disclosed in German Application 197 12 077.6. Just like the placement device 30, the tape dispenser can, if necessary, have a positive inclination or a vertical or a negative inclination.

The suction generating transport and guide arrangement of the guide plate 2 with negative inclination retains the print medium 3 transferred thereto by the placement device 30 opposite the influence of the force of gravity, this arrangement initially prevents the print medium from falling over onto the conveyor belt 10 by producing a high initial pressure $p_a$—generated by the pump 12—and subsequently tautens the surface of the print medium 3 during the course of transport as a result of a rise in the guide given an increasingly larger suction area $\Sigma A$ on the print medium surface 300, and given simultaneously decreasing pressure p. The pressure p' of the second transport and guide arrangement 20' of the auxiliary device is reduced close to the placement edge 31. An over-stretching or tearing of the surface to be printed is avoided on the basis of slippage in the vertical direction on the conveyor belt 10. A lifting of even thin print media from the placement edge 31 is likewise reliably avoided and the additional sensor 9 can therefore be foregone. At the same time, a slip-free transport in the transport direction is guaranteed by the interaction with the conveyor belt 10 of the transport mechanism 1.

This second version of the inventive apparatus—shown in FIG. 1*b*—likewise has a guidance without clamping and is equally suited for a guide plate 2 positively or negatively inclined relative to the normal of the reference plane. The recessed region in the guide plate 2 has at least one recess 21 for an ink print head 4 whose nozzle plane is arranged parallel to the guide plate 2, and the structure of the guide plate 2 following the recess 21 in the transport direction (downstream) is fashioned such that the print medium 3 lies there-against in non-contacting fashion at the level of this recess 21 and the drying of the ink dots is accelerated.

A blower arrangement 121 which produces an air stream is provided for fast drying of the ink. The solvent evaporation is thus accelerated and the evaporating solvent of the ink is quickly eliminated. The blow arrangement 121 is preferably a component of the motorized suction pump 12. The air stream is directed onto the surface 300 of the print medium 3. Blowing with the air stream also accelerates detachment of the print medium 3 from the guide structure and rotation into the desired deposit position.

Figure 2B:
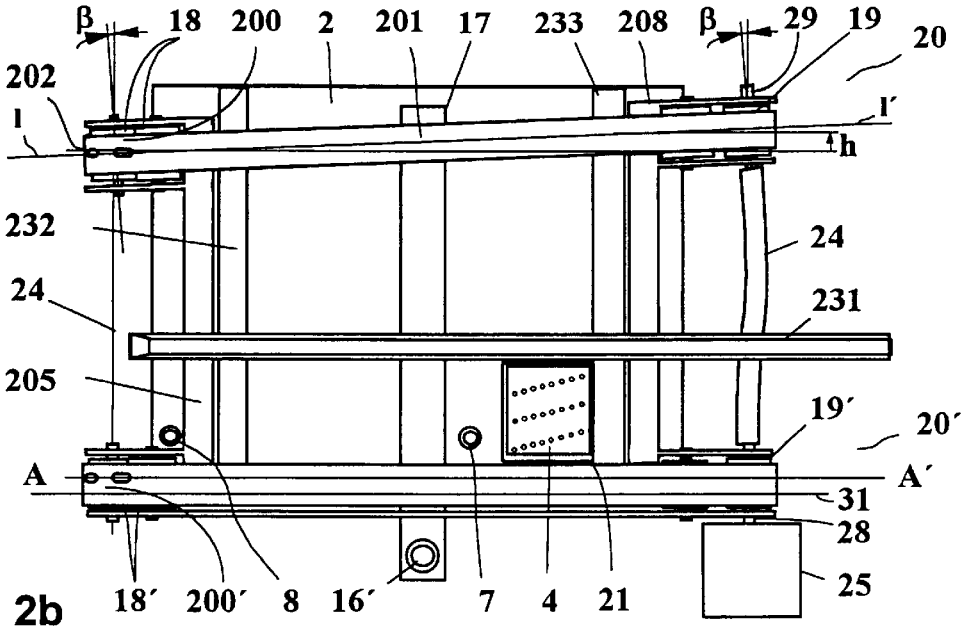
FIG. 2*b* is a view of the inventive auxiliary device at the guide plate according to the second version of the invention.

FIG. 2*b* shows a view of the auxiliary device at a guide plate for tautening the print medium surface and for guidance without clamping in conformity with the second version. The print medium 3 has not yet been detected by the sensor 8, and the conveyor belts 201, 201' of the transport and guide arrangement 20, 20' have not yet been activated and remain in the illustrated initial position. One side of each of the conveyor belts 201, 201' without openings thereby lies in the printing region between the retainer rails 205 and 208 and the other sides of the respective conveyor belts 201, 201' with the openings 202, 202' are outside the print region following the guide plate 2. Surface parts 200, 200' of the conveyor belts 201, 201' with the openings 202, 202' then lie directly preceding the detection region of the sensor 8. The surface part 200, 200' of the conveyor belts enter into contact with the surface part 300 of the print medium 3 when a placement of the print medium 3 by the placement auxiliary device 30 (not shown here) has been detected by the sensor 8 and the conveyor belts 201, 201' are placed in motion.

The transport and guide arrangements 20, 20' exert suction on parts of the print medium surface at both sides of the region to be printed. The first transport and guide arrangement 20 effects a rise h along the line I–I' between the retainer rails 205 and 208 with reference to the guidance of the suctioned parts of the surface 300 of the print medium 3. The further transport and guide arrangement 20' holds the parts of the surface 300 of the print medium 3 in the proximity of the placement edge 31.

The width of the conveyor belt 201' or of the further transport and guide arrangement 20' amounts to a maximum of 8 mm. The recess 21 for the ink jet print head 4 begins at the distance of approximately 9 mm from the placement edge 31 on the surface of the conveyor belt 10. It is thus assured that the pressure on the surface 300 of the print medium 3 already can become effective at a distance of approximately 10 mm from the placement edge 31. Such a requirement exists, for example, when franking mailings.

The width of the conveyor belt 201 or of the first transport and guide arrangement 20 can vary compared thereto.

Figure 3B:
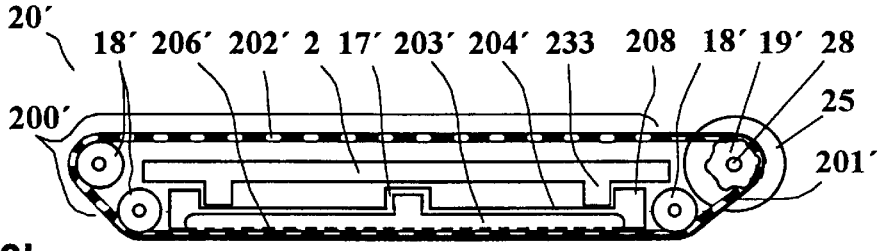
FIG. 3*b* is a section along the line A–A' through an auxiliary device at the guide plate in the second version of the invention.

FIG. 3*b* shows a section through the line A–A' of the auxiliary device at the guide plate 2. A driver roller 19' that drives the conveyor belt 201' is secured on the axle 28 of the drive 25. The conveyor belt 201' is seated around the guide plate 2 with guide rollers 18' and has a predetermined length. The conveyor belt 201' lies in air-tight fashion on the suction housing 204' or the perforated plate 206' of the transport and guide 20' of the auxiliary device. The side of the conveyor belt 201' without openings lies in the printing region between the retainer rails 205 and 208 and closes the suction chamber 203' or the openings of the perforated plate 206' as long as the conveyor belt 201' is placed by the drive 25 in a motion synchronized to the transport motion of the conveyor belt 10. A shaft 24 connects the axle 28 of the drive 25 to the axle 29 of the drive roller 19 for the conveyor 201. The two axles 28 and 29 are at the angle β relative to one another. The shaft 24 can be fashioned flexibly or as a Cardan shaft.

The conveyor belt 201' runs over guide rollers 18' and a drive roller 19' with the same transport speed as the conveyor belt 10 shown in FIG. 1*b* as soon as the sensor 8 detects a print medium 3. The drives of the transport mechanism 1 and the auxiliary device are preferably coupled to one another. A drive 25 of the auxiliary device for the drive motor 19' operates synchronously with the drive of the drive drum 11'. To that end, the drive 25 is connected to control unit 40 that controls a corresponding switchover or clutch.

Figure 4B:
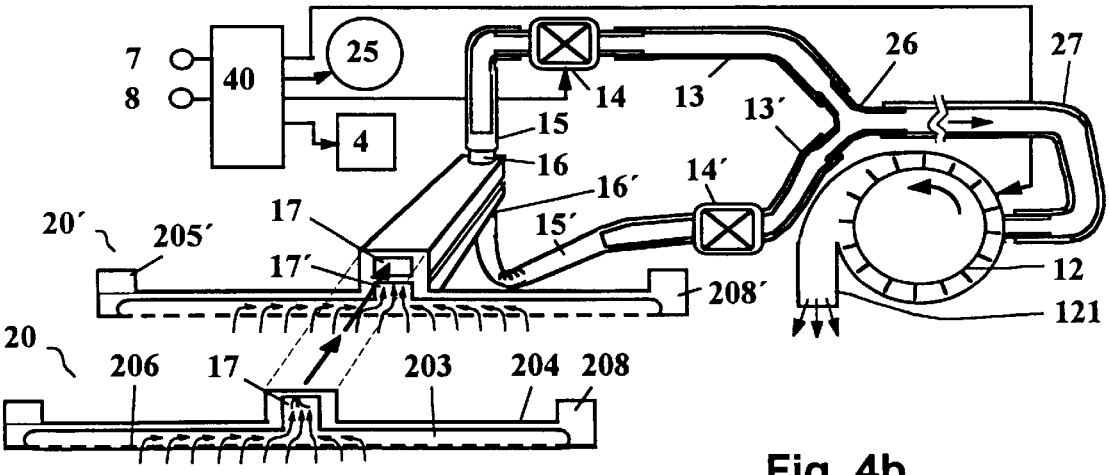
FIG. 4*b* schematically illustrates the air guidance arrangement of the auxiliary device at the guide plate and the control thereof in the second version of the invention.

FIG. 4*b* schematically shows an arrangement for the air guide at the guide plate 2 and the control thereof for the second version of the inventive auxiliary device. The air guide at the guide plate 2 ensues by a succession of connected components as explained in conjunction with the first version with reference to FIG. 4*a*. From the suction chamber 203 of the transport and guide arrangement 20 of the auxiliary device, the air guidance ensues via the suction manifold 17, the connector 16, the pressure hose 15 to the control valve 14, the pressure hoses 13 and 27 to the motorized suction pump 12 with a blower arrangement 121 accelerating the ink drying. Also, the air guidance ensues from a suction space 203' of the further transport and guide arrangement 20' of the auxiliary device arranged at the guide plate 2 close to the placement line 31, likewise via the suction manifold 17', a connector 16', a pressure hose 15' to the uncontrolled valve 14' as well as the pressure hoses 13' and 27 to the motorized suction pump 12. A hose connection piece 26 connects the pressure hoses 13 and 13', which are brought in from the valves 14, 14' of the two transport and guide arrangements 20 and 20', to the pressure hose 27 to the motorized suction pump 12. Alternatively, a second motorized suction pump 12' can be utilized, in which case the hose connection piece 26 and the pressure hose 27 to the motor suction pump 12 are then omitted. The blower arrangement 121 for accelerating ink drying is arranged downstream of the ink jet print head 4 at the level of the recess 21 of the guide plate 2.

The control unit 40 has an input side connected to the sensor 7 and 8 and an output side connected to the drive 25, the controllable valve 14 and the motorized suction pump 12. Given an increase in suction proceeding beyond a predetermined value, the valve 14 draws secondary air from the environment. The size of the predetermined suction level is controllable by the control unit 40. The uncontrolled valve 14' draws secondary air from the environment when a permanently set magnitude of the suction is transgressed, the permanently set magnitude always stronger than the suction set with the controllable valve 14. The controllable valve 14 is thereby driven such that the force exerted for overcoming the static friction exerted by the transport and guide arrangement 20 becomes lower and lower given progressing transport, so that neither a tearing nor a lift-off of the print medium can ensue, but only a tautening of the surface of the print medium.

Figure 5:
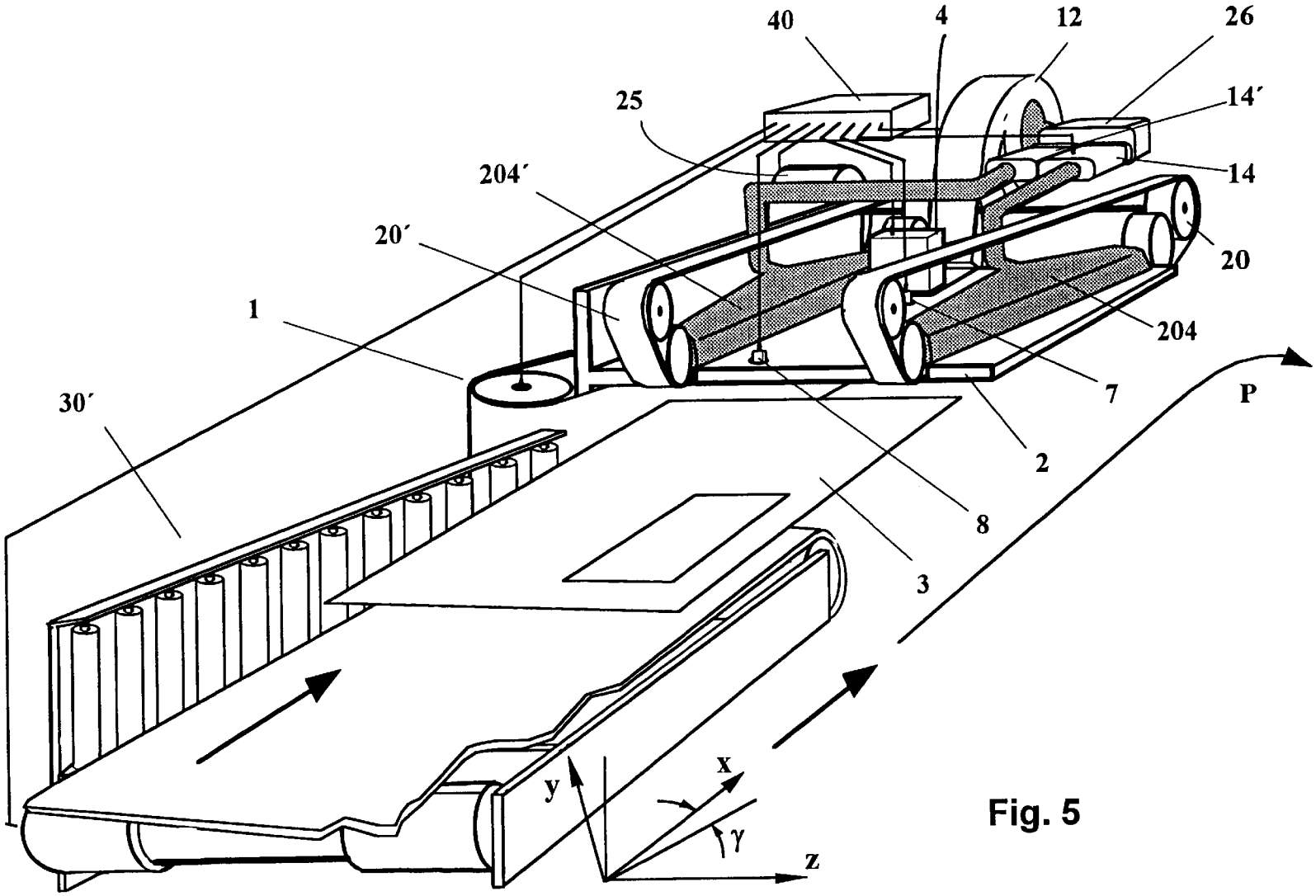
FIG. 5 shows a version for horizontal print medium transport.

If the inclination angle α for the inventive device of the second version shown in FIG. 1*b* (an auxiliary device at a guide plate negatively inclined relative to the normal of the reference plane) is enlarged further, a further version with a horizontal print medium transport arises in the limit case. FIG. 5 shows such a further version with horizontal print medium transport. A transport mechanism 1, preferably a circulating conveyor belt, is arranged orthogonal to the guide plate 2 that has auxiliary devices 20, 20'. The auxiliary devices exert no counter-pressure whatsoever on the print medium 3.

Given different thicknesses and masses of the letters 3 to be conveyed, a force F to be intercepted (braked) by the printing station occurs given a high transport velocity V:

$$F=m\cdot a=m\cdot V/t \tag{3}$$

According to this equation, a high force F would be required given a large mass of the print mechanism 3. Given pressing against a guide plate with a resilient counter-pressure (clamping) means, disturbing vibrations could thus be transmitted. Inventively, a counter-pressure means can again be foregone and a pre-control with a specifically fashioned placement device 30' is the only thing additionally required, this undertaking a rough thickness matching and an adaptation of the placement angle γ and of the inclination angle α. The letter 3 then proceeds to be seated against the guide plate 2 whose sensor 8 detects the letter 3. The control unit 40 initiates the transport by the inventive auxiliary device that sucks up the letter. This is correspondingly constructed and, just as in the second version, is equipped with two transport and guide arrangements 20, 20' that, however, must exert a greater force in view of the horizontal transport. A lifting of the letter surface relative to the letter content thereby ensues in the printing region at the guide plate 2, in contrast to which the underside of the letter and the letter content remain essentially on that level that is predetermined by the placement angle γ and (if present) the inclination angle α of the placement auxiliary device 30'. For pre-control, zx-transport plane placement of the device 30' is adjustable at the conveyor belt level upwardly/downwardly in the y-direction—in a way that is not shown. This achieves the advantage that the letter 3 no longer needs to be accelerated up to the guide plate 2 in the printing station and then decelerated and likewise need not be pressed against the guide plate 2 with a counter-pressure device for clamping. Vibrations are thus avoided. The surface of the envelope or comparable print medium should merely proceed against the guide plate 2. The high-mass fill of the envelope should not strike the guide plate. For adhering to these conditions, the pre-control and acceleration in the placement device 30' are set matched to one another, taking the placement angle γ into consideration. This matching ensues such that every print medium is always brought onto a predetermined parabolic curved path P by the placement auxiliary device 30'. The printing station is reached at a point placed close to the apex of the parabolic path P. The surface which the ink jet print head 4 should print in non-contacting fashion through the recess 21 is again tautened by the suctioning against the two transport and guide arrangement 20, 20'. The exhaust air arising during suctioning can again be used for drying in order to improve the smear resistance of the fresh imprint. A positive slope h/2 in the guidance of the transport and guide arrangement 20 and a negative slope h'/2 in the guidance of the transport and guide arrangement 20' now simultaneously act in opposite directions and thus lead to the tautening. The conveyor belts 201 and 201' are consequently respectively arranged obliquely at an angle of β/2 relative to the transport direction. The conveyor belt of the transport mechanism 1 now lies at the side. The edge of the letter presses on the surface thereof due to the guidance of the transport and guide arrangement 20' with negative rise h'/2.

The valves 14 and 14' are thereby driven such that the force exerted for overcoming the static friction exerted by the transport and guide arrangement 20 and 20' in fact becomes lower and lower given proceeding transport but the retaining force is adequate for seating the letter surface against the guide plate 2 until the end of printing. In collaboration with the inertia of a mass to remain at rest, the letter 3 having been accelerated by the pre-control with the specifically fashioned placement auxiliary device 30', a suction higher by one order of magnitude must only be produced by the motorized suction pump 12 given a high transport velocity. Inventively, the placement auxiliary device 30' generates a parabolic path P with a greatest approach at the middle of the guide plate. The control unit 40 is connected to the sensors 7, 8 and actuators and is fashioned and appropriately programmed for the synchronization of all transport motions.

A device (not shown) for removing dust, fibers and similar disturbing particles from the surface to be printed can be provided between the placement auxiliary device 30' and the guide plate 2 or in the placement auxiliary device 30' or in the guide plate 2. This device preferably works according to a vacuum cleaner principle and is connected to the motorized suction pump 12 via a hose, an uncontrolled valve and a filter as well as via the connector 26, or has a separate drive.

Although various minor modifications might be suggested by those skilled in the art, it should be understood that our wish to embody within the scope of the patent warranted hereon all such modifications as reasonably and properly come with the scope of our contribution to the art.

We claim as our invention:

1. An apparatus for transporting and printing a print medium, comprising:

a guide plate having a recess therein;

transport means, having a transport surface disposed orthogonally to said guide plate, for moving a print medium along said transport surface in a transport direction;

an ink jet print head rigidly disposed in said recess of said guide plate during printing;

control means for controlling said ink jet print head for causing said ink jet print head to print on said print medium when said print medium is moved adjacent said ink jet print head by said transport means, thereby producing a printed region on said print medium;

said recess having a length in said transport direction so that said printed region of said print medium is free of mechanical contact downstream of said ink jet print head in said transport direction; and an auxiliary device having an ascending guide which non-mechanically holds said print medium adjacent said ink jet print head during printing and allows a predetermined slippage of said print medium in a direction perpendicular to said transport surface.

2. An apparatus as claimed in claim 1 wherein said guide plate is inclined at an angle relative to a vertical reference.

3. An apparatus as claimed in claim 1 wherein said guide plate is inclined at a positive angle from a vertical reference, wherein said transport means comprises means for moving said print medium with an edge of the print medium adjacent said transport surface, and wherein said print medium has a print medium surface facing said guide plate and said ink jet print head, and wherein said auxiliary device includes transport and guide means including means for exerting suction on said print medium surface and an upwardly sloping guide for operating in combination to stretch a distance of portions of said print medium surface disposed remote from said printed region from portions of said print medium surface disposed proximate to said edge of said print medium adjacent said transport surface, for thereby tautening said print medium surface under an influence of gravity.

4. An apparatus as claimed in claim 3 wherein said guide plate comprises a first seating rail disposed preceding said ink jet print head in said transport direction and a second seating rail disposed following said ink jet print head in said transport direction, and wherein said auxiliary device comprises first and second retainer rails respectively disposed against said first and second seating rails, said transport and guide means comprising a conveyor belt mounted on said first and second retainer rails at a predetermined distance from said edge of said print medium, said conveyor belt guiding said print medium at an ascending angle in said transport direction along a line between first and second retainer rails, said transport and guide means including a suction manifold and means communicating with said suction manifold for exerting suction on said surface of said print medium through said conveyor belt.

5. An apparatus as claimed in claim 4 wherein said transport and guide means of said auxiliary device comprises guide rollers and a drive roller around which said conveyor belt is entrained and drive means connected to said drive roller and operated by said control unit for moving said conveyor belt of said transport and guide means of said auxiliary device at a same speed as said transport surface of said transport means, and sensor means for detecting a print medium for supplying a signal to said control unit for starting said conveyor belt of said transport and guide means of said auxiliary device.

6. An apparatus as claimed in claim 5 wherein said transport means includes a transport means drive, and wherein said apparatus comprises means for linking said transport means drive and said drive means of said transport and guide means of said auxiliary device to each other for synchronous operation upon a signal from said sensor means.

7. An apparatus as claimed in claim 6 wherein said means for linking comprises an axle connected to said drive roller via a shaft which compensates for said angle.

8. An apparatus as claimed in claim 7 wherein said shaft comprises a shaft selected from the group consisting of a flexible shaft and a Cardan shaft.

9. An apparatus as claimed in claim 5 wherein said conveyor belt has a perforated region and a non-perforated region disposed in succession along a length of said conveyor belt, and wherein said transport and guide means of said auxiliary device comprises a suction chamber, disposed inside a path of said conveyor belt in communication with said suction manifold, and suction producing means, also in communication with said suction manifold, for producing a predetermined suction, said control means, upon receiving said signal from said sensor means, operating said drive means for moving said conveyor belt to place said perforated region in registration with said suction chamber, and in an absence of said signal from said sensor means, causing said drive means to maintain said non-perforated region of said conveyor belt in registration with said suction chamber.

10. An apparatus as claimed in claim 9 further comprising means controlled by said control means for adjusting suction, wherein said conveyor belt has a length comprising a sum of a shortest print medium length and a shortest distance between two successively transported print media, and wherein said control means comprises means for operating said drive means for advancing said conveyor belt by one revolution upon an occurrence of said sensor signal and for causing said means for adjusting suction to increase said suction, and for stopping said conveyor belt after one revolution and lowering said suction in an absence of said sensor signal.

11. An apparatus as claimed in claim 10 wherein said means for adjusting suction comprises a motorized suction pump operated by said control unit and a controllable valve for causing a force exerted by said suction to decrease in said transport direction as transport of said print medium proceeds along said transport direction for preventing lift-off of said print medium from said conveyor belt and for tautening said surface of said print medium.

12. An apparatus as claimed in claim 11 wherein said control means comprises means for initiating printing by said ink jet print head dependent on a transport speed of said print medium, and further comprising means for preventing said suction from exceeding a predetermined suction value.

13. An apparatus as claimed in claim 9 further comprising means connected to said means for producing suction for generating an air stream across said printed region of said print medium, downstream in said transport direction from said ink jet print head, for accelerating ink drying on said print medium.

14. An apparatus as claimed in claim 9 wherein said ink jet print head is disposed immediately above said transport surface, and wherein said apparatus further comprises means controlled by said control unit for adjusting said suction, and a further sensor means for supplying a further signal to said control unit if said print medium departs from said transport surface, said control unit, upon receipt of said further signal, causing said means for adjusting suction to reduce the suction.

15. An apparatus as claimed in claim 1 wherein said auxiliary device comprises first transport and guide means for exerting suction on portions of said print medium surface remote from said printed region and having a sloping guide which ascends relative to said transport surface, and second transport and guide means for exerting suction on portions of said print medium surface at opposite sides of said region to be printed close to said edge of said print medium on said transport surface and parallel to said transport direction, said first and second transport and guide means comprising, in combination, means for tautening said print medium surface.

16. An apparatus as claimed in claim 15 wherein said guide plate comprises a first seating rail disposed preceding said ink jet print head in said transport direction and a second seating rail disposed following said ink jet print head in said transport direction, and wherein said auxiliary device comprises first and second retainer rails respectively disposed adjacent said first and second seating rails, said first and second transport and guide means being mounted on said first and second retainer rails, and wherein each of said first and second transport and guide means comprises a conveyor belt having a perforated section and a non-perforated section disposed in succession along a length of the conveyor belt, guide rollers and a drive roller around which the conveyor belt is entrained, and drive means for rotating said conveyor belt operated by said control means, and a suction chamber disposed inside a path of the conveyor belt, and wherein said apparatus comprises a sensor which produces a sensor signal when said region to be printed is disposed between said retainer rails, said control means receiving said sensor signal and thereupon operating the drive roller of each of said first and second transport and guide means to synchronize movement of the respective conveyor belts of the first and second transport and guide means, and said apparatus further comprising a controlled valve, controlled by said control unit, for causing said first transport and guide means to exert a predetermined suction on said print medium, and an uncontrolled valve which draws ambient air if a predetermined suction level is exceeded.

17. An apparatus as claimed in claim 16 comprising a single suction source shared by said first and second transport and guide means, with the respective suction chambers of said first and second transport and guide means connected in common to said single suction source.

18. An apparatus as claimed in claim 16 further comprising means disposed downstream of said ink jet print head for generating an air stream across said printed region of said print medium for accelerating drying on said print medium.

19. An apparatus as claimed in claim 3 wherein said placement means comprise means for adapting said print medium for either a horizontal transport or a vertical transport by said transport means.

20. An apparatus as claimed in claim 19 wherein said placement device comprises a placement guide plate having angle adjustable guide rails against which said print medium moves.

21. An apparatus as claimed in claim 2 further comprising placement means, preceding said transport means in said transport direction, for receiving said print medium and for positioning said print medium at said angle and for moving said print medium at said angle into said transport means.

* * * * *